United States Patent [19]

Woodle

[11] 4,006,769

[45] Feb. 8, 1977

[54] VERTICAL VENETIAN BLIND CONSTRUCTION

[76] Inventor: Allan S. Woodle, 420 Mount Pleasant Ave., Mamaroneck, N.Y. 10543

[22] Filed: June 22, 1976

[21] Appl. No.: 698,530

[52] U.S. Cl. ..... 160/166 A; 160/176 R

[51] Int. Cl.[2] ..... E06B 9/26

[58] Field of Search ..... 160/166 A, 168, 172, 160/176

[56] References Cited

UNITED STATES PATENTS

| | | | |
|---|---|---|---|
| 2,807,322 | 9/1957 | Toti | 160/168 |
| 3,134,428 | 5/1964 | Kehrer et al. | 160/176 |
| 3,860,056 | 1/1975 | Bruneau | 160/176 |
| 3,921,694 | 11/1975 | Galex | 160/172 |

FOREIGN PATENTS OR APPLICATIONS

| | | | |
|---|---|---|---|
| 1,341,556 | 12/1973 | United Kingdom | 160/166 A |

*Primary Examiner*—Peter M. Caun

*Attorney, Agent, or Firm*—Charles E. Temko

[57] ABSTRACT

An improved vertical venetian blind construction incorporating means for assuring that the individual blind slats will be uniformly oriented when in a closed condition so as to present a uniform appearance and provide for even light control. The novel construction includes the suspension of each slat within a rectilinear channel by a hemispherically shaped supporting member, the surface of which is provided with a pair of oppositely disposed flat surfaces which exert a camming action under the force of gravity to urge individual slats to the same angular relation relative to the plane of the window in which the blind is installed.

3 Claims, 8 Drawing Figures

VERTICAL VENETIAN BLIND CONSTRUCTION

BACKGROUND OF THE INVENTION

Vertical venetian blinds have come into considerable prominence in recent years, both as a substitute for the more common horizontal type, and for use in installations which are wholly unsuited for horizontal type blinds. One relatively expensive construction employs a horizontally oriented worm which drives a separate pinion on each slat to simultaneously vary the adjusted angle of the slat between open and closed positions. A construction of substantially lower cost involves the suspending of each slat at an upper end thereof by a clamp member having an upstanding pintle terminating in a hemispherically shaped member which rides upon the edges of a horizontally oriented slot in a supporting element fixed to the upper horizontal portion of a window frame, wall or ceiling. These slats may be drawn by pulling ball chains linking the slats together, and rotation about a vertical axis by pulling other ball chains linking these slats, depending upon the desired direction of rotation. In constructions of this type, because of the difficulty of meeting close commercial tolerances, equal angular rotation of each slat with a pair of chains is not readily obtained, resulting in the rotation of the slats to relatively closed overlapped relation in an uneven manner, with accompanying unsatisfactory appearance and light control.

SUMMARY OF THE INVENTION

Briefly stated, the invention contemplates the provision, in a device as above described, of means of assuring a uniform closing action in each of a plurality of vertically oriented blind slats, by providing a pair of oppositely disposed flat surfaces on either side of the hemispherical surface of the individual slat clamp or supporting members which ride in the above mentioned horizontally oriented slot, which surfaces, under the action of gravity cause a camming action tending to rotate an associated pintle supported by the slot to a predetermined angular position. Thus, should a degree of slack exist between two adjacent vertically oriented slats, which is greater than in that portion of the chain linking other adjacent slats, each slat will be rotated to an approximately closed condition, following which the camming action provided by the oppositely disposed flat surfaces continues the rotation motion to bring the slat to proper closed orientation.

BRIEF DESCRIPTION OF THE DRAWING

In the drawing, to which reference will be made in the specification, similar reference characters have been employed to designate corresponding parts throughout the several views.

DETAILED DESCRIPTION OF THE DISCLOSED EMBODIMENT

Figure 1:
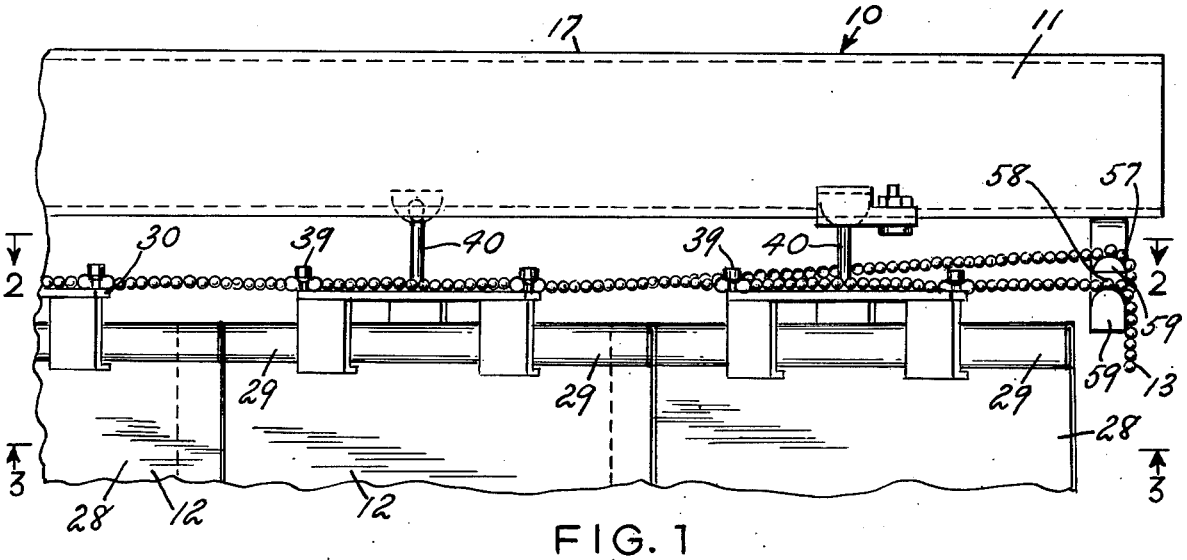
FIG. 1 is a fragmentary side elevational view, partly in section, of an embodiment of the invention.

In accordance with the invention, the device, generally indicated by reference character 10 (FIG. 1), comprises broadly a generally horizontally oriented blind supporting track element 11, a plurality of individual vertically oriented slats 12, and ball chain tilting means 13.

The track element 11 may be of any convenient configuration, and is commonly of an extruded metallic type. It includes an upper wall 17 adapted to be screwed to a horizontal portion of a window frame (not shown) in well known manner, first and second side walls 18 and 19, respectively, and a bifurcated lower wall 20 forming a continuous longitudinal slot 21, the upper edges 22 of which form a track supporting the slats 12.

Figure 4:
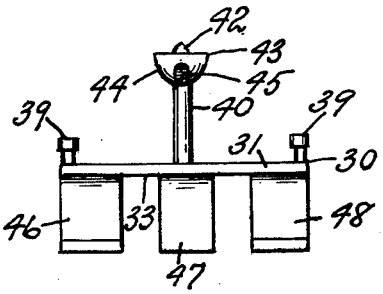
FIG. 4 is a side elevational view of an individual slat support element forming a part of the disclosed embodiment.
Figure 6:
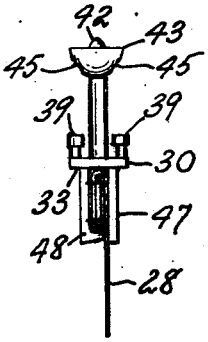
FIG. 6 is a top plan view thereof.
Figure 5:
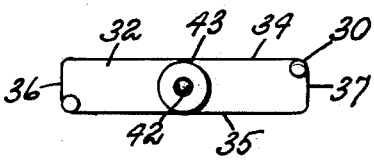
FIG. 5 is an end elevational view of a slat support element.
Figure 7:
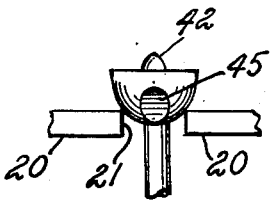
FIG. 7 is an enlarged sectional view showing the engagement of a slat support element with a supporting track element in a first opened position thereof.

The slats 12 include individual slat members 28 of cloth, aluminum or rigid vinyl having folded upper edge portions 29, each being engaged in clipped relation with a slat support element 30 (FIGS. 4 to 6, inclusive). Each element 30 includes a horizontal base wall 31 bounded by an upper surface 32, a lower surface 33, longitudinal edges 34 and 35, as well as end edges 36 and 37. Extending vertically from the upper surface 32 are pairs of ball chain engaging studs 39 of known type and a centrally disposed vertical shaft 40, the upper end 42 of which is engaged with a hemispherically shaped enlargement 43. The enlargement 43 is bounded by a downwardly extending spherically surface 44 having a pair of oppositely disposed angularly positioned flat surfaces 45 extending inwardly from the spherical surface. Depending downwardly from the lower surface 33 are a plurality of clip members 46, 47 and 48, each having a laterally extending flange 49 adapted to clip the folded portion 29 of the cloth slat member 28, as is known in the art.

The tilting means 13, as has been mentioned, includes first and second ball chains 53 and 54 having clip means 55 which engage the studs 39, again, as known in the art. The end portions 57 and 58 may be entrained over horizontally oriented guides 59, or any other convenient mechanism to permit manual imparting of tension selectively on either end to result in simultaneous rotation of each of the slats 12.

Figure 2:
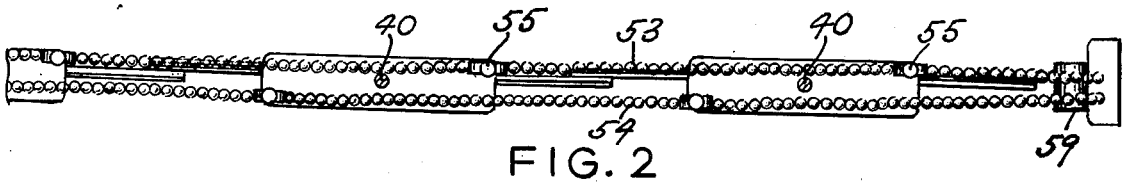
FIG. 2 is a horizontal sectional view thereof as seen from the plane 2—2 in FIG. 1.
Figure 3:
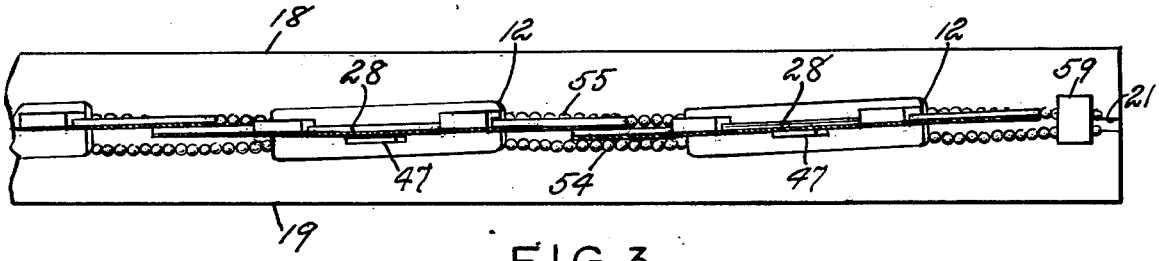
FIG. 3 is a horizontal sectional view, as seen from the plane 3—3 in FIG. 1.
Figure 8:
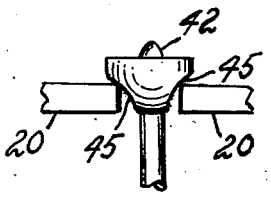
FIG. 8 is a similar enlarged sectional view thereof showing a second closed position.

FIGS. 1, 2 and 3 disclose the device 10 in relatively closed condition in which the slats 12 overlap each other for effective light control and the presentation of a substantially uniform appearance to a viewer. In this condition, the flat surfaces 45 become aligned with the edges of the slot 21, and as seen in FIG. 8 in the drawing, the weight of the individual slats 12 cause these surfaces to exert a camming action in which the shaft 40 descends slightly with respect to the element 11. The weight of the individual slats in descending provides sufficient work to overcome any frictional forces involved, and when the shaft 40 has fully descended, a detenting action takes place which requires positive effort imparted to one of the ball chains 54–55 in order to dislodge the slats from detented condition. When this latter operation has been accomplished, the enlargement 43 has been rotated to a degree sufficient to bring the spherical surfaces into contact with the edges of slot 21, at which point the shaft 40 rises slightly, permitting the individual slats to be rotated to any desired degree while riding on the spherical surface.

I wish it to be understood that I do not consider the inventon limited to the precise details of structure shown and set forth in this specification, for obvious modifications will occur to those skilled in the art to which the invention pertains.

I claim:

1. In a vertical venetian blind construction of a type including a horizontally oriented support element defining an elongated slot forming a track, a plurality of vertically oriented slats having slat support means at an upper end thereof engaging said track for longitudinal and rotational movement relative thereto, and linking means interconnecting portions of each of said slats for simultaneously imparting rotational movement thereto between relatively open and closed positions, improved means for guiding each of said slats to a common angular position irrespective of minor variations in the length of ball chain segments interconnecting adjacent slats, said means comprising: each of said slats support elements including a vertically oriented shaft member penetrating said elongated slot in said blind support element, a spherically shaped enlargement adjacent an upper end of said shaft, the lower surface of which slidably engages the edges of said elongated slot, there being a pair of oppositely disposed flat surfaces forming camming detents extending inwardly from the spherical surfaces thereof, and adapted to rest upon said edges of said elongated slot when said slats are in relatively closed condition in which the longitudinal edges of said slats are in mutually overlapped relation.

2. Structure in accordance with claim 1, further characterized in said flat surfaces being disposed at a mutual acute angle.

3. Structure in accordance with claim 1 in which the edges of said flat surfaces are slightly rounded to facilitate disengagement from the edges of said elongated slot.

* * * * *